US005816087A

United States Patent [19]

Katsumura et al.

[11] Patent Number: 5,816,087

[45] Date of Patent: Oct. 6, 1998

[54] METHOD FOR PRODUCING A SEAMLESS STEEL TUBULAR PRODUCT

[75] Inventors: Tatsuro Katsumura; Yusuke Minami; Masahiko Yasukawa, all of Tokyo, Japan

[73] Assignee: NKK Corporation, Tokyo, Japan

[21] Appl. No.: 633,169

[22] Filed: Apr. 16, 1996

[51] Int. Cl.[6] ..... B21B 45/02; B21D 30/02

[52] U.S. Cl. ..... 72/41; 72/325; 72/97

[58] Field of Search ..... 72/325, 265, 39, 72/41, 43, 97, 209

[56] References Cited

U.S. PATENT DOCUMENTS

| | | | |
|---|---|---|---|
| 3,153,482 | 10/1964 | Buntz et al. | 72/265 |
| 3,818,733 | 6/1974 | Cauley et al. | 72/41 |
| 4,353,238 | 10/1982 | Breton et al. | 72/209 |

FOREIGN PATENT DOCUMENTS

| | | |
|---|---|---|
| 56-89307 | 7/1981 | Japan . |
| 61-42404 | 2/1986 | Japan . |
| 63-192504 | 8/1988 | Japan . |
| 63-54066 | 10/1988 | Japan . |
| 1-266905 | 10/1989 | Japan . |
| 2-133106 | 5/1990 | Japan . |
| 2-284708 | 11/1990 | Japan . |
| 3-124305 | 5/1991 | Japan . |
| 4-8498 | 2/1992 | Japan . |
| 4-274806 | 9/1992 | Japan . |
| 870750 | 6/1961 | United Kingdom . |

OTHER PUBLICATIONS

Patent Abstracts of Japan, vol. 014, No. 026 (M–921), 18 Jan. 1990, of JP–A–01 266905 (Nippon Steel Corp), 24 Oct. 1989.

Patent Absrtacts of Japan, vol. 017 No. 068 (M–1365), 10 Feb. 1993 of JP–A–04 274806 (NIppon Steel Corp), 30 Sep. 1992.

Patent Abstracts of Japan, vol. 015, No. 325 (M–1148), 19 Aug. 1991 of JP–A–03 124305 (NIppon Steel Corp), 27 May 1991.

Patent Abstracts of Japan, vol. 005, No. 162 (M–092), 17 Oct. 1981 of JP–A–56 089307 (Kawasaki Steel Corp), 20 Jul. 1981.

Patent Abstracts of Japan, vol. 010, No. 200 (M–48), 12 Jul. 1986 of JP–A–61 042404 (Sumitomo Metal Ind Ltd), 28 Feb. 1986.

*Primary Examiner*—Lowell A. Larson
*Assistant Examiner*—Rodney A. Butler
*Attorney, Agent, or Firm*—Frishauf, Holtz, Goodman, Langer & Chick, P.C.

[57] ABSTRACT

A seamless steel tubular product is produced by hot-piercing an alloy-steel billet with a piercing plug to produce a hollow shell and then rolling the hollow shell. Prior to the hot-piercing, a steel sheet is joined to an end surface of the billet into which the plug is to be driven, such that the steel plate may not project beyond the periphery of the billet, the steel plate having a surface area (C) satisfying the equation:

$$S \times 0.2 \leqq C \leqq S \times 1.2$$

where, S is represented (plug bottom radius)$^2$×3.14.

12 Claims, 1 Drawing Sheet

METHOD FOR PRODUCING A SEAMLESS STEEL TUBULAR PRODUCT

BACKGROUND OF THE INVENTION

1. Field of the Invention

The present invention relates to a method for producing a seamless steel tubular product and, more particularly, to improvement in durability of a piercing plug.

2. Description of the Related Arts

In general, a seamless steel tubular product is produced as follows. A round or square billet is formed into a hollow shell by Mannesmann piercing, press piercing or hot extrusion. The hollow shell is rolled by rolling mill such as an elongator, a plug mill and a mandrell mill. The rolled hollow shell is formed into a final product having a predetermined size by a sizer and a stretch reducer.

A plug used for the Mannesmann piercing and press piercing is liable to be damaged since the plug contacts with a billet heated to a high temperature of 1100° to 1300° C., and since the plug is required to sustain heavy load. Piercing plug yet can withstand several hundreds of piercing cycles when used for piercing a billet for low-alloy steel such as carbon steel, but becomes unusable after only several piercing cycles due to heavy damage when used in piercing billets for high-alloy steels represented by 13 Cr steel, SUS 304, SUS 316 and 32 Ni steel. Such an extremely short life of service inevitably leads to a rise in the tool cost.

Hitherto, methods such as (1) to (4) shown below have been proposed to overcome the problem of insufficiency of piercing plug encountered in piercing of high-alloy steel billets.

(1) To use, as the material of the piercing plug, a material having a strength in high temperature higher than the alloy steel of the billet, e.g., molybdenum (Mo), thereby preventing damaging of the plug. (Japanese Unexamined Patent Publication No. 2-133106, hereinafter referred to as "Prior Art 1")

(2) To supply a lubricant between the billet and the plug from a recessed surface of the plug, thereby diminishing damaging of the plug. (Japanese Unexamined Patent Publication No. 2-284708, hereinafter referred to as "Prior Art 2")

(3) To put a hard material on the plug surface by various surface treatment, so as to prevent seizure and wear, thus extending the life of the plug (Japanese Unexamined Patent Publication No. 63-192504, hereinafter referred to a "Prior Art 3")

(4) To control heat-treatment atmosphere and other factor so as to enhance thickness and adhesion of a scale produced during oxidation treatment, thus achieving higher durability. (Japanese Examined Patent Publication No. 63-54066, hereinafter referred to as "Prior Art 4")

It is found, however, that only few cases have been successfully carried out in the Prior Arts mentioned above. For instance, the Prior Art 2 encounters with difficulty in the supply of lubricant in successive piercing cycles, although it can eliminate seizure between the billet and the plug in the first piercing cycle.

Supply of lubricant is possible by a different method. The lubricant is supplied through the head of the plug via a passage formed in a plug bar which supports the plug. This method, however, involves a problem in regard to damaging of the plug end or clogging of the same and, hence, cannot be continuously used in piercing.

The Prior Art 1 relying upon the use of Mo as the plug material has many advantages such as prevention of deformation of the plug itself, prevention of seizure, and so forth. Mo, however, is expensive and the plug made of this material is rather brittle and tends crack. Thus, the Prior Art 1 also is unsatisfactory when used in industrial scale.

As to the Prior Art 3, the hard material is liable to be cracked and the surface-treated layer is easy to peel off. This method therefore has not yet matured to such a level as to be practically used on actual machines.

Under these circumstances, a technology has been long wanted which can extend the service life of the piercing plug, using conventional alloy steel as the plug material. To cope with such a demand, Japanese Examined Patent Publication No. 4-8498 (hereinafter referred to as "Prior Art 5") discloses that the alloy composition of the plug material used in the Prior Art 4 has been improved.

The Prior Art 5 paid attention to oxide scale on the plug surface which is generally understood to have heat-insulating and anti-seizure effects. The Prior Art 5 proposes to lower the chromium content as compared with conventionally used plug of 3Cr-1Ni steel used for piercing of ordinary steels, and to add at least one selected from molybdenum (Mo), tungsten (W), niobium (Nb), cobalt (Co) and vanadium (V), thereby enabling dense and strong oxide film on the plug surface, while maintaining the strength in high temperature. Now, the plug thus produced including Conventional Plug is referred to as "alloy steel plug".

According to the Prior Art 5, the life of the alloy steel plug is dependent on the Cr content and the temperature of oxidation treatment, as a result of addition of the above-mentioned elements such as Mo, W, Nb, Co and/or V. In other words, lowering Cr content and optimization of oxidation treatment can extend the service life of alloy steel plug about 2.5 to 3 times. It is therefore found that the Prior Art 5 can offer extended life of the plug without necessitating any specific limitation or condition.

The Prior Art 5, however, is still unsatisfactory in that no substantial reduction in the tool cost can be achieved, because the elements added to maintain strength are expensive. Furthermore, considering that initial scale is not produced uniformly and service life of the plug fluctuates is shortened by peel-off of the initial scale, the Prior Art 5 cannot effectively lower the production cost, although it contributes to improvement in efficiency of rolling and working.

To sum up, the prior arts 1 to 5 have the following merits and demerits.

In the case that an alloy steel plug is used and the high-temperature strength of the plug is lower than that of a billet, the plug strength decreases due to temperature rise during the piercing and the plug tends to be deformed by a heavy load applied to the plug. Even if a high-temperature strength of the alloy steel plug is nearly equal to that of the billet, the alloy steel plug suffers from a damage attributable to so called "rough surface", as a result of possible seizure between the billet and the plug. As one of the foregoing measures for preventing temperature rise and seizure which causes the damage, the method has been known which makes effective use of oxide film which is usually formed on the plug surface.

In order that the oxide film formed on the plug surface is effectively utilized, the thickness, stability and adhesion of the film are important factors. Nevertheless, it is impossible in the piercing of a billet of high alloy steel to maintain for a long time the piercing condition equivalent to those in the piercing of billets of carbon steels. Improved plugs having hardened surface, plugs of a heat-resistant alloy or plugs of Mo or Mo alloy as explained in the mentioned prior arts are used when piercing a billet of a material which would inevitably cause damaging of the alloy steel plug. Such improved plugs, however, cannot provide extended service and reduction in cost, due to reasons such as brittleness, high price and so forth. Thus, no effective measure has been established yet which would simultaneously meet the requirements of reduction in the production cost, improvement in the rolling efficiency and extension of plug life.

Thus, it has been long wanted but not yet established to extend the life of service of the plug in a simple and inexpensive way, reduce the production cost and improve the rolling efficiency.

SUMMARY OF THE INVENTION

It is an object of the present invention to provide a method for producing a seamless steel tubular product which is capable of extending the service life of a plug so as to make it possible to produce a high-alloy steel seamless tubular product at a low cost without affecting rolling efficiency.

To attain the object, the present invention provides a method for producing a seamless steel tubular product comprising the steps of:

preparing a billet made of an alloy steel, the billet having two end surfaces and an outer peripheral surface;

hot-piercing the billet by a plug to produce a hollow shell; and rolling the hollow shell, characterized by further comprising the step of:

joining, before the hot-piercing the billet, a steel plate on an end surface of the billet into which the plug is to be driven so that the steel plate does not extend beyond the outer peripheral surface of the billet;

the steel plate having a surface area (c) which satisfies the following equation:

$$S\times 0.2 \leqq C \leqq S\times 1.2$$

where, S is represented by { (plug bottom radius)$^2\times 3.14$}.

Furthermore, a volume (V) of the steel plate preferably satisfies the following condition:

$$A\times 0.1 \leqq V \leqq A\times 5$$

where, A represents a cross-sectional area of the billet.

In addition, it is also preferred that the steel plate is made of a carbon steel or a low-alloy steel having a content of elements other than iron lower than that in the alloy steel as the billet material.

DESCRIPTION OF THE EMBODIMENT

Figure 1:
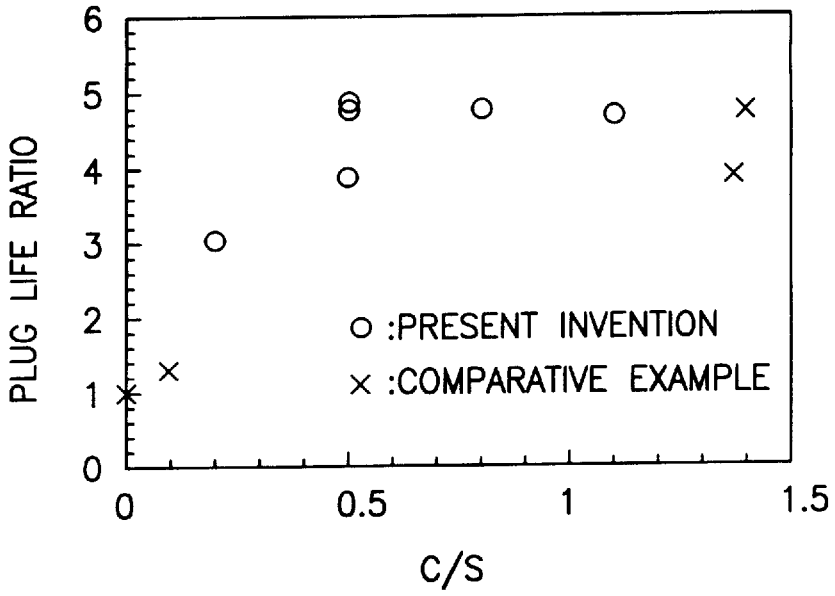
FIG. 1 is a graph showing the relationship between the surface area of the steel plate and the life ratio of a plug.

According to the present invention, a billet made of alloy steel is firstly prepared. A steel plate is joined on an end surface of the billet into which the plug is to be driven so that the steel plate does not extend beyond the outer peripheral surface of the billet. Then, the billet with the steel plate-is hot-pierced to produce a hollow shell. Finally, the hollow shell is rolled to obtain a seamless steel tubular product.

(1) The reason why the plug life is extended by joining the steel plate on the billet is as follows.

As described before, drawbacks of Mannesmann piercing or plug piercing in regard to the plug are difficulty in external supply of a lubricant for preventing seizure and temperature rise, and occurrence of peeling of a lubricant film due to severeness of piercing work, even if the supply of the lubricant is perfomed in a form of the film in advancing of piercing. Thus, even an oxide film which is most widely used at present in actual rolling practice can sustain only several passes or piercing cycles. This is because the heat treatment for forming anti-seizure oxide film is carried out before piercing and such oxide film can be consumed away before long during the piercing.

In the present invention, supply of oxide scale from the billet side to the plug is carried out by joining the steel plate on the billet. The oxide scale is supplied to form an oxide film each time the piercing is done, in a manner materially equivalent to that performed by heat treatment for forming the film. As the result, the life of the plug is extended. It is true that the oxide scale is formed on the billet itself. However, the billet alone cannot provide the above-described effect when the alloy steel used as the billet is a high-alloy steel as represented by a stainless steel or a heat-resistant alloy which exhibits much less oxide film formation as compared with carbon steels or low-alloy steels. According to the present invention, in order to supplement the insufficiency of supply of the oxide scale provided by the billet itself, a steel plate is joined to the end surface of the billet into which the piercing plug is to be driven and, if necessary, a similar steel plate is joined also to the other end surface, so that the oxide scale formed by the steel plate is transferred positively to the plug so as to produce lubricating and heat-insulating effects. The joining of the steel plate to the billet may be effected by bonding with a suitable adhesive, welding or the like. The joining methods are not necessarily limited to those mentioned.

(2) The following defects tend to be caused when the piercing is effected across the steel plate joined to the billet. Firstly, a steel plate in the form of a punched blank remains after the piercing on the plug bar which supports the plug. Secondly, a steel composition which otherwise would not exist, e.g., carbon steel composition, remains on the inner surface of the pierced high-alloy steel tube. These defects undesirably impairs the efficiency of the work.

Regardless of whether the steel plate remains in the hollow shell, ring-shaped steel plate tends to remain on the plug when the size of the joined steel plate is too large, and such residual steel plate is rolled into the hollow shell in the next piercing cycle so as to damage the inner surface of the hollow shell. Rolling of the joined steel plate onto the inner surface of the hollow shell in one hand provides good lubrication effect but on the other hand undesirably requires laborious work for finishing the inner surface of the tube in order to meet the requirement for quality of high-alloy steel tubular product. Thus, the rolling of the steel plate in the hollow shell does not contribute to reduction in the production cost. It is therefore important that the surface area of the steel plate and, as it may be required, the volume of the steel plate inclusive of the thickness are suitably determined in relation to the sizes of the billet and the plug.

(3) As described in the foregoing paragraph (1), one of the critical features of the present invention resides in that the plug is prevented from direct contact with the billet of high-alloy steel so as to maintain heat-insulating and lubrication effects on the plug. The advantages of the present invention, therefore, cannot be enjoyed when the steel plate easy to seize is joined to the billet. It is preferred to use, as the material of the steel plate to be joined, a steel having a composition which at high temperature produces a compound serving as the major lubrication component such as FeO or a compound of a silicon oxide and Fe. Thus, ordinary carbon steels (i.e., about 0.05–0.6 wt. % C), high silicon steels and low-alloy steels having contents of elements other than Fe lower than those of the billet can suitably be used.

For these reasons, the method of the present invention features that a steel plate is joined to at least one end surface of the billet into which the plug is to be driven, and the surface area of the steel plate is determined in relation to the sizes of the billet and the plug.

More specifically, the steel plate is joined such that the steel plate may not project beyond the peripheral surface of the billet.

At the same time, the surface area (C) of the steel plate should satisfy the equation (1):

$$S\times0.2\leqq C\leqq S\times1.2 \quad (1)$$

where, S is represented by (plug bottom radius)$^2\times3.14$

When the surface area (C) is below the value of S×0.2, the steel plate cannot provide any appreciable effect in extending the service life of the plug, whereas, when the surface area (C) is over the value of S×1.2, a steel plate having the ring-shaped blank in the punched form remains on the plug bar which supports the plug after the piercing. Such remaining steel plate with the ring-shaped blank is rolled into the hollow shell during the piercing of the next billet, which damages the inner surface of the pierced hollow shell. In order that the steel plate is closely adhered to the billet end surface, it is quite natural that the steel sheet is joined perpendicularly to the axis of the billet. The reason for the definition that joined steel plate should not project beyond the outer peripheral surface of the billet is that otherwise, a disadvantage of separation of the steel plate from the billet may occur, for example, during transportation of the billet.

The invention also proposes to further define the volume (V) of the steel plate, in order to eliminate troublesome finishing work after piercing while extending the life of service of the plug.

To attain this object, the volume (V) of the steel plate should satisfy the equation (2):

$$A\times0.1\leqq V\leqq A\times5 \quad (2)$$

where, A represents the cross-sectional area of the billet.

The length of the joined steel plate which remains on the inner surface of the hollow shell after the piercing is correlated to the volume (V) of the steel plate. When the volume (V) is over the value of A×5, it is necessary to cut the billet in a length greater than that of ordinary crop or to conduct a laborious work for finishing the internal surface of the tubular product, whereas, when the volume (V) is below the value of A×0.1, no appreciable effect is obtained in regard to the extension of plug life.

Although the billet of high-alloy steels to be pierced was explained above, the present invention can be well applied to piercing of billets of alloy steels other than the high-alloy steel and billets of non-steel alloys. Examples of such alloys are:

(1) JIS NCF 600 {(Inconel 600) 72Ni-14Cr-6~10Fe}

(2) JIS NCF 825 {(Incoloy 825) 38~46Ni-19.5~23.5 Cr-Fe}

As will be understood from the foregoing description, according to the present invention, it is possible to remarkably extend the service life of a plug used in piercing a billet of a high-alloy steel by a simple measure to joint a steel plate to an end surface of the billet, thus overcoming the problem of too short plug life encountered in the production of a seamless steel tubular product from such high-alloy steel billet which has high additional value but is difficult to roll. Therefore, according to the present invention, it is possible to produce a high-alloys steel seamless tubular product by using exactly the same way as the conventional method and using an alloy steel plug inclusive of conventional plugs, while enjoying remarkably extended life of the plug. Furthermore, the product can be finalized without employing any specific work to be added to the conventional method of finishing. It is thus possible to improve the rolling efficiency and, hence, to reduce the cost of production.

DETAILED DESCRIPTION OF THE INVENTION

Examples

Examples of the present invention will be described with reference to the drawings.

Example 1

High-alloy steel billets of 13Cr steel were used. A steel plate of an ordinary carbon steel was jointed to the end surface of the billet to which the piercing plug is to be driven (this end surface is referred to as "front end surface") or to the other end surface of the billet (this is referred to as "rear end surface") or both to the front and rear end surfaces, such that the steel plate or plates may not project beyond the outer periphery of the billet, whereby a plurality of sample billets were prepared. Thee steel plates on different sample billets had different surface areas as shown in Table 1. Sample billets having no such steel plate were also prepared. Each of the sample billets with or without the steel plates was subjected to a process for making seamless steel tubular products. The process comprises the steps of hot-piercing a billet by a plug made of a conventional 3Cr-1Ni steel to form a hollow shell and rolling the hollow shell to produce a seamless steel tubular product. The durability of service life of the plugs used, as well as the property of the seamless steel tubular product, were examined to obtain results as shown in Table 1 and FIG. 1. Table 1 also shows surface areas and thicknesses, as well as data concerning the joint portion, of the sample billets. The plug life ratio is expressed in terms of values standarized by the length of plug life as observed when a billet of 13Cr steel having no steel plate joined was pierced. The surface area of the steel plate in Table 1 was obtained actually by measuring the surface area of the steel sheet. The "plug bottom area" as the value (plug bottom radius)$^2\times3.14$ was actually determined by measuring the projection area of the plug bottom. The piercing operation was conducted under the following conditions:

Gorge rolling reduction: 7 to 15%

Heating temperature: 1050° to 1300° C. (varied according to billet steel type)

Billet material: 13Cr steel

Billet diameter: 170 ϕ or 230 ϕ

Piercing plug: Conventional plug (made of 3Cr-1Ni steel)

Material of joined steel plate: Ordinary carbon steel

Referring to Table 1 and FIG. 1, it is under stood from comparison between Examples 2 and 3 of the invention and the Reference Example that greater effect in extension of the plug service life can be obtained when the steel plate is joined to the front end surface of the billet or both the front and rear end surfaces of the billet than when the steel plate is joined only to the rear end surface of the billet, provided that steel plates of the same size are used. It should be noted, however, that plug service life can be extended appreciably even when the steel plate is joined only to the rear end surface as in Reference Example.

It is also seen that large effect in extending the plug service life can be obtained, as well as appreciable improvement in the efficiency of work, when the size of the steel plates fall within the scope specified by the present invention, as in the cases of Examples 1 to 5.

In particular, Examples 2, 3 and 4, which satisfy the conditions shown below, exhibited specifically a long plug service life as compared with other Examples and evaluated as being excellent, which is marked by "+e,sez ⊙+ee ".

$S \times 0.3 \leqq C \leqq S \times 0.9$ where S: (plug bottom radius)$^2 \times 3.14$ C: Surface area of steel plate Thus, Examples 1 and 5 are evaluated as good, which is marked by "○".

Comparative Example 3, which largely deviates from the scope of the invention in regard to the steel plate, undesirably allowed part of the steel plate to remain on the plug bar, although it showed substantially the same effect in extending plug service life as Examples of the invention. As a consequence, problems were caused such as damaging of the pipe inner surface, resulting in impairment of the efficiency of work. Comparative Example 3 was therefore evaluated as being not good, which is marked by "x".

Comparative Example 2, which employed a steel plate having a size smaller than that specified by the invention could not show substantial improvement in the plug service life over Comparative Example 1 which did not employ any steel sheet and, hence, was evaluated as being not good as marked by "x".

Example 2

Seamless steel tubular products were produced under the same piercing conditions as Example 1, while employing various billet materials and different surface areas of the steel plate, in order to investigate the influences of the presence of the steel plate on the effect of extending plug service life, as well as the influence of variation of the steel plate size. The results are shown in Table 2.

From table 2, it is seen that Examples 6 to 12 of the invention employing steels plates of sizes falling within the range specified by the invention exhibit plug life lengths 5 to 10 times larger than that observed when steel plate was not used, regardless of the type of the billet material.

Billets of 32Ni steel were pierced in Example 1 and Comparative Example 6. In the case of Comparative Example 6 which did not use any steel plate, piercing was impossible, which is marked by "xx", whereas, in Example 12 of the invention which employed a steel plate, at least one pass of piercing could be performed, which is marked by "○".

Example 3

Seamless steel tubular products were produced by using 13Cr steel billets, while employing steel plates of different volumes and surface areas, under the same piercing conditions as Example 1, in order to investigate the influence of presence of the steel plate on the effect in extending plug service life, as well as influence of variation of steel plate volume. The results are shown in Table 3 and FIG. 2. The plug life ratio was determined by standardization by the life length as obtained when a 13Cr steel billet without steel plate was pierced.

Figure 2:
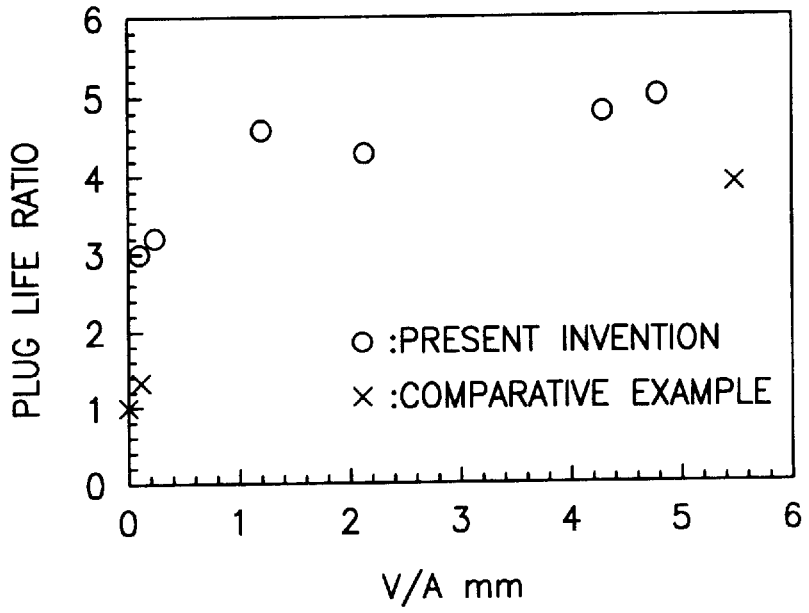
FIG. 2 is a graph showing the relationship between the volume of the steel plate and the life ratio of the plug.

The range of the volume of the steel plate to be joined which provides appreciable plug life extending effect is broad as seen from FIG. 2. This is attributable to the fact that the volume is a function of both the joining area and the sheet thickness.

Among the samples falling within this broad range, Examples 15 to 18, which satisfy the following requirement, showed excellent results as marked by "○", both in the aspects of piercing characteristic and the amount of the steel plate remaining on the pipe inner surface. Namely, these Examples did not cause any trouble in regard to the efficiency of work and the quality of the product.

$A \times 0.3 \leqq C \leqq A \times 2.5$ where A: cross-sectional area of billet V: volume of steel plate The term "cross-sectional area of billet" is the cross-sectional area of the billet at a plane taken perpendicular to the axis of the billet.

Example 4

Seamless steel tubular products were produced using 13Cr steel billets under the same conditions as Example 1, while employing various types of steels as the steel plate to be joined. The volumes V of the steel plates were determined to fall within the range of $A \times 0.3 \leqq C \leqq A \times 2.5$, that is, $V = A \times 1.0$. Table 4 shows the results of investigation conducted to find relationship between the type of the steel of the steel plate to be jointed and the effect in extension of the plug service life. The plug life ratio was determined by standardization by the life length as obtained when a 13Cr steel billet without the steel plate was pierced.

From Table 4, it is seen that Comparative Examples 10 to 13, which employed steel compositions of steel plates similar to the 13Cr steel used as the billet material, did not show substantial improvement in the effect in extending the service life, which is marked by "xx". Meanwhile, Example 19 of the invention, which employed a steel sheet of an ordinary carbon steel, showed distinguished effect in extending the plug service life, as marked by "○". Examples 20 to 22 employing low-alloy steels of 1 to 5 Cr also showed good results in the effect in extending the plug service life, which is marked by "○".

Although Examples 1 to 4 described above employ billets of high-alloy steel, the inventors also have confirmed that advantageous effects similar to those described above are obtainable even when the billets are of low-alloy steels contrasted to the above-mentioned high-alloy steel or of an alloy other than alloy steel, e.g., an Ni-based alloy.

In Examples 1 to 4 described above, conventional plugs of 3Cr-Ni steel were used for the piercing plugs. It is clear that effects equivalent to or superior to those acquired with these Examples are obtainable-when alloy steel plugs, which inherently possess service life twice as long as that of the conventional plug, are used as the piercing plugs.

As stated in foregoing, the present invention offers remarkable advantages from an industrial point of view, by providing a method in which, by a simple measure of joining a steel plate to an end surface of a billet to be pierced. The life of the piercing plug is remarkably extended to enable the plug to sustain much greater number of piercing cycles even when the billet is of a high-alloy steel which is generally difficult to pierce. The present invention therefore makes it possible to produce seamless steel tubular products of high-alloy steel by a process which is substantially the same as the conventional process, using a piercing plug which also has been used conventionally, thus contributing greatly to improvement in rolling efficiency and reduction in the production cost. Furthermore, finishing of the seamless tubular product after the piercing can be conducted in the same way as the conventional method.

TABLE 1

| No. | Surface Area of Joined Steel Plates ($mm^2$) | Thickness (mm) | Plug Life Ratio | Steel Plate Joint Position | Evaluation | Remarks |
|---|---|---|---|---|---|---|
| Comp. Ex. 1 | — | — | 1.0 | — | × | Ordinary piercing |
| Comp. Ex. 2 | 0.1S | 2.3 | 1.3 | T | × | |
| Inv. Ex. 1 | 0.2S | 2.3 | 3.0 | T | ○ | |
| Inv. Ex. 2 | 0.5S | 2.3 | 4.8 | T | ◎ | |
| Ref. Ex. | 0.5S | 2.3 | 3.8 | B | ◎ | |
| Inv. Ex. 3 | 0.5S | 2.3 | 4.7 | TB | ◎ | |
| Inv. Ex. 4 | 0.8S | 2.3 | 4.7 | T | ◎ | |
| Inv. Ex. 5 | 1.1S | 2.3 | 4.6 | T | ○ | |
| Comp. Ex. 3 | 1.4S | 2.3 | 4.7 | T | × | Ring-shaped steel sheet remained |

S: Plug bottom area (Projection area),
T: Billet front end,
B: Billet rear end

TABLE 2

| No. | Billet Type | Surface Area of Joined Steel Plate | Thickness | Plug Life Ratio | Steel Plate Joint Position | Evaluation | Remarks |
|---|---|---|---|---|---|---|---|
| Comp. Ex. 4 | SUS304 | — | — | 0.4 | — | × | Ordinary piercing |
| Inv. Ex. 6 | SUS304 | 0.5S | 2.3 | 7.8 | T | ◎ | |
| Inv. Ex. 7 | SUS304 | 0.7S | 2.3 | 8.2 | T | ◎ | |
| Inv. Ex. 8 | SUS304 | 0.7S | 2.3 | 8.5 | TB | ◎ | |
| Comp. Ex. 5 | SUS316 | — | — | 0.3 | — | × | Ordinary piercing |
| Inv. Ex. 9 | SUS316 | 0.5S | 2.3 | 6.7 | T | ◎ | |
| Inv. Ex. 10 | SUS316 | 0.7S | 2.3 | 6.8 | T | ◎ | |
| Inv. Ex. 11 | SUS316 | 0.7S | 3.5 | 7.1 | T | ◎ | |
| Comp. Ex. 6 | 32NiSteel | — | — | 0.0 | T | ×× | Piercing impossible due to plug rupture |
| Inv. Ex. 12 | 32NiSteel | 0.7S | 3.0 | 0.3 | B | ◎ | Piercing possible in one or more passes |

S: Plug bottom area (projection area),
T: Billet front end,
B; Billet rear end

TABLE 3

| No. | Types of Joined Plate Vol. ($mm^3$) | Cross-Sectional Area (mm) | Thickness (mm) | Plug Life Ratio | Steel Sheet Joint Position | Evaluation | Remarks |
|---|---|---|---|---|---|---|---|
| Comp. Ex. 7 | 0.0 | — | — | 1.0 | — | × | Ordinary piercing |
| Inv. Ex. 13 | 0.15A | 0.2S | 1.0 | 3.0 | T | ○ | |
| Comp. Ex. 8 | 0.13A | 0.1S | 2.3 | 1.3 | T | × | Area insufficiency |
| Inv. Ex. 14 | 0.26A | 0.2S | 2.3 | 3.2 | T | ○ | |
| Inv. Ex. 15 | 1.22A | 0.5S | 4.0 | 4.6 | T | ◎ | |
| Inv. Ex. 16 | 2.14A | 0.7S | 5.0 | 4.3 | T | ◎ | |
| Inv. Ex. 17 | 4.30A | 1.0S | 7.0 | 4.8 | T | ◎ | |
| Inv. Ex. 18 | 4.80A | 1.1S | 7.1 | 5.0 | T | ◎ | |
| Comp. Ex. 9 | 5.50A | 1.1S | 8.1 | 3.9 | T | × | Joined steel Plate remained on tube inner surface |

A: Billet cross-sectional area, S; Plug bottom area (projection area), T: Billet front end

| No. | Types of Joined Steel Plate | Joined Steel Plate Surface Area ($mm^2$) | Thickness (mm) | Plug Life Ratio | Steel Sheet Joint Position | Evaluation |
|---|---|---|---|---|---|---|
| Inv. Ex. 19 | Ordinary carbon steel | 0.7S | 2.3 | 5.3 | T | ⊙ |
| Inv. Ex. 20 | 1CrSteel | 0.7S | 2.3 | 4.0 | T | ○ |
| Inv. Ex. 21 | 2.25CrSteel | 0.7S | 2.3 | 3.5 | T | ○ |
| Inv. Ex. 22 | 5CrSteel | 0.7S | 2.3 | 3.0 | T | ○ |
| Comp. Ex. 10 | 9CrSteel | 0.7S | 2.3 | 1.8 | T | × |
| Comp. Ex. 11 | 13CrSteel | 0.7S | 2.3 | 0.9 | T | × |
| Comp. Ex. 12 | SUS304 | 0.7S | 2.3 | 0.6 | T | ×× |
| Comp. Ex. 13 | SUS316 | 0.7S | 2.3 | 0.4 | T | ×× |

S: Plug bottom area (projection area), T: Billet front end

What is claimed is:

1. In a method of producing a seamless steel tubular product comprising the steps of:

preparing a billet made of an alloy steel, the billet having a first and a second end surface and an outer peripheral surface;

hot-piercing the billet by a Mannesmann piercing using a plug to produce a hollow shell; and rolling the hollow shell, the improvement comprising the step of:

joining, before hot-piercing the billet, a steel plate to the first end surface of the billet into which the plug is to be driven so that the steel plate does not extend beyond the outer peripheral surface of the billet;

said steel plate forming an oxide scale, at the hot-piercing temperature, which functions to lubricate the plug during hot-piercing; and said steel plate having a surface area (C) which satisfies the following equation:

$$S\times 0.2 \leqq C \leqq S\times 1.2$$

where, S is represented by {(plug bottom radius)$^2$× 3.14}.

2. The method of claim 1, wherein said steel sheet has a volume (V) which satisfies the following condition:

$$A\times 0.1 \leqq V \leqq A\times 5$$

where, A represents a cross-sectional area of the billet.

3. The method of claim 1, wherein said steel plate is one which is made of a carbon steel.

4. The method of claim 1, wherein said steel plate is one which is made of a low-alloy steel having a content of elements other than iron lower than that in the alloy steel of the billet material.

5. The method of claim 1 further comprising the step of joining, before hot-piercing the billet, a steel plate to the second surface of the billet;

said steel plate forming an oxide scale, at the hot-piercing temperature, which can function to lubricate the plug during hot-piercing; and said steel plate having a surface area (C) which satisfies the following equation:

$$S\times 0.2 \leqq C \leqq S\times 1.2$$

where, S is represented by { (plug bottom radius)$^2$× 3.14}.

6. The method of claim 2, wherein said steel plate is one which is made of a carbon steel.

7. The method of claim 2, wherein said steel plate is one which is made of a low-alloy steel having a content of elements other than iron lower than that in the alloy steel of the billet material.

8. The method of claim 7, wherein each said steel sheet has a volume (V) which satisfies the following condition:

$$A\times 0.1 \leqq V \leqq A\times 5$$

where A represents a cross-sectional area of the billet.

9. The method of claim 7, wherein each said steel plate is made of a carbon steel.

10. The method of claim 7, wherein each said steel plate is made of a low-alloy steel having a content of elements other than iron lower than that in the alloy steel of the billet material.

11. The method of claim 8, wherein each said steel plate is made of a carbon steel.

12. The method of claim 8, wherein each said steel plate is made of a low-alloy steel having a content of elements other than iron lower than that in the alloy steel of the billet material.

* * * * *